US008979574B2

(12) United States Patent
Daily, Jr. et al.

(10) Patent No.: US 8,979,574 B2
(45) Date of Patent: Mar. 17, 2015

(54) MODULAR PLUG

(71) Applicant: Tyco Electronics Corporation, Berwyn, PA (US)

(72) Inventors: Christopher George Daily, Jr., Harrisburg, PA (US); Edward John Howard, Millersbug, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 108 days.

(21) Appl. No.: 13/763,007

(22) Filed: Feb. 8, 2013

(65) Prior Publication Data

US 2014/0051278 A1 Feb. 20, 2014

Related U.S. Application Data

(63) Continuation-in-part of application No. 13/586,408, filed on Aug. 15, 2012, now Pat. No. 8,714,994.

(51) Int. Cl.

| | |
|---|---|
| ***H01R 13/58*** | (2006.01) |
| ***H01R 13/514*** | (2006.01) |
| ***H01R 4/24*** | (2006.01) |
| ***H01R 24/64*** | (2011.01) |
| *H01R 13/506* | (2006.01) |

(52) U.S. Cl.

CPC ..... *H01R 13/514* (2013.01); *H01R 4/2433* (2013.01); *H01R 24/64* (2013.01); *H01R 13/506* (2013.01); *H01R 13/5825* (2013.01); *H01R 13/5837* (2013.01); *H01R 2201/04* (2013.01)

USPC ..... 439/467; 439/676

(58) Field of Classification Search

USPC ..... 439/467, 465, 409–410, 607.41, 607, 439/941, 676

See application file for complete search history.

(56) References Cited

U.S. PATENT DOCUMENTS

| | | | | |
|---|---|---|---|---|
| 6,231,387 | B1 * | 5/2001 | Kameyama | 439/578 |
| 7,021,967 | B2 * | 4/2006 | Mullin | 439/607.41 |
| 7,578,695 | B2 * | 8/2009 | Boeck et al. | 439/463 |
| 8,298,922 | B2 * | 10/2012 | Schumann et al. | 438/467 |
| 8,714,994 | B2 * | 5/2014 | Daily et al. | 439/344 |
| 2008/0057793 | A1 | 3/2008 | Gerber et al. | |
| 2013/0045642 | A1 | 2/2013 | Wu | |

FOREIGN PATENT DOCUMENTS

| | | |
|---|---|---|
| EP | 1 914 844 A2 | 4/2008 |

* cited by examiner

*Primary Examiner* — Xuong Chung Trans

(57) ABSTRACT

A modular plug includes a plug housing, plug contacts held by the plug housing, and a stuffer cap coupled to the plug housing. The stuffer cap includes a cable channel configured to receive a cable therein. The stuffer cap includes an interior side that defines at least a portion of the cable channel. The modular plug includes a strain relief member held by the plug housing. The strain relief member includes a base and a spring beam extending from the base such that the spring beam is cantilevered from the base. The spring beam is configured to engage the cable and thereby pinch the cable between the interior side of the stuffer cap and the spring beam.

19 Claims, 9 Drawing Sheets

238
242
242
242

214
218
284b
284a
282
287
240
242
244
246
248
250
252
254
256
258
260
262
264
266
268
270
272
274
276
278
280
282
284
286
288
290
292
294
296
298
300
302
304
306
308
310
312
314
316
318

MODULAR PLUG

CROSS REFERENCE TO RELATED APPLICATIONS

This application is a continuation-in-part of U.S. patent application Ser. No. 13/586,408, filed Aug. 15, 2012, and entitled "MODULAR PLUG FOR POWER APPLICATIONS", the subject matter of which is herein incorporated by reference in its entirety.

BACKGROUND OF THE INVENTION

The subject matter herein relates generally to modular plugs.

In electrical systems, there is increasing concern for powering electronic devices. Some electrical systems supply power over typical connectors. For example, industry standard type RJ-45 communication connectors provide Power over Ethernet connections by supplying current along the 8 signal circuits. Such connectors have limited current carrying capability.

A connector capable of having higher current carrying ability is needed.

BRIEF DESCRIPTION OF THE INVENTION

In one embodiment, a modular plug includes a plug housing, plug contacts held by the plug housing, and a stuffer cap coupled to the plug housing. The stuffer cap includes a cable channel configured to receive a cable therein. The stuffer cap includes an interior side that defines at least a portion of the cable channel. The modular plug includes a strain relief member held by the plug housing. The strain relief member includes a base and a spring beam extending from the base such that the spring beam is cantilevered from the base. The spring beam is configured to engage the cable and thereby pinch the cable between the interior side of the stuffer cap and the spring beam.

In another embodiment, a modular plug includes a plug housing, plug contacts held by the plug housing, and a strain relief member held by the plug housing. The strain relief member includes a base and a spring beam cantilevered from the base. A stuffer cap is pivotally coupled to the plug housing. The stuffer cap includes a cable channel configured to receive a cable therein. The stuffer cap includes an interior side that defines at least a portion of the cable channel. The stuffer cap is configured to press wires of the cable into electrical contact with the plug contacts when the stuffer cap is pivoted to a closed position. The stuffer cap includes a slot that extends through the stuffer cap into the cable channel. The slot is configured to receive the spring beam of the strain relief member therein as the stuffer cap is pivoted to the closed position such that the spring beam pinches the cable between the interior side of the stuffer cap and the spring beam.

In another embodiment, a modular plug includes a cable having an insulative cable jacket and an end, a plug housing, and plug contacts held by the plug housing. A stuffer cap is coupled to the plug housing. The stuffer cap includes a cable channel and an interior side that defines at least a portion of the cable channel. The end of the cable is received within the cable channel. A strain relief member is held by the plug housing. The strain relief member includes a base and a spring beam cantilevered from the base. The spring beam is engaged with the insulative jacket of the cable such that the cable is pinched between the interior side of the stuffer cap and the spring beam.

DETAILED DESCRIPTION OF THE INVENTION

Figure 1:
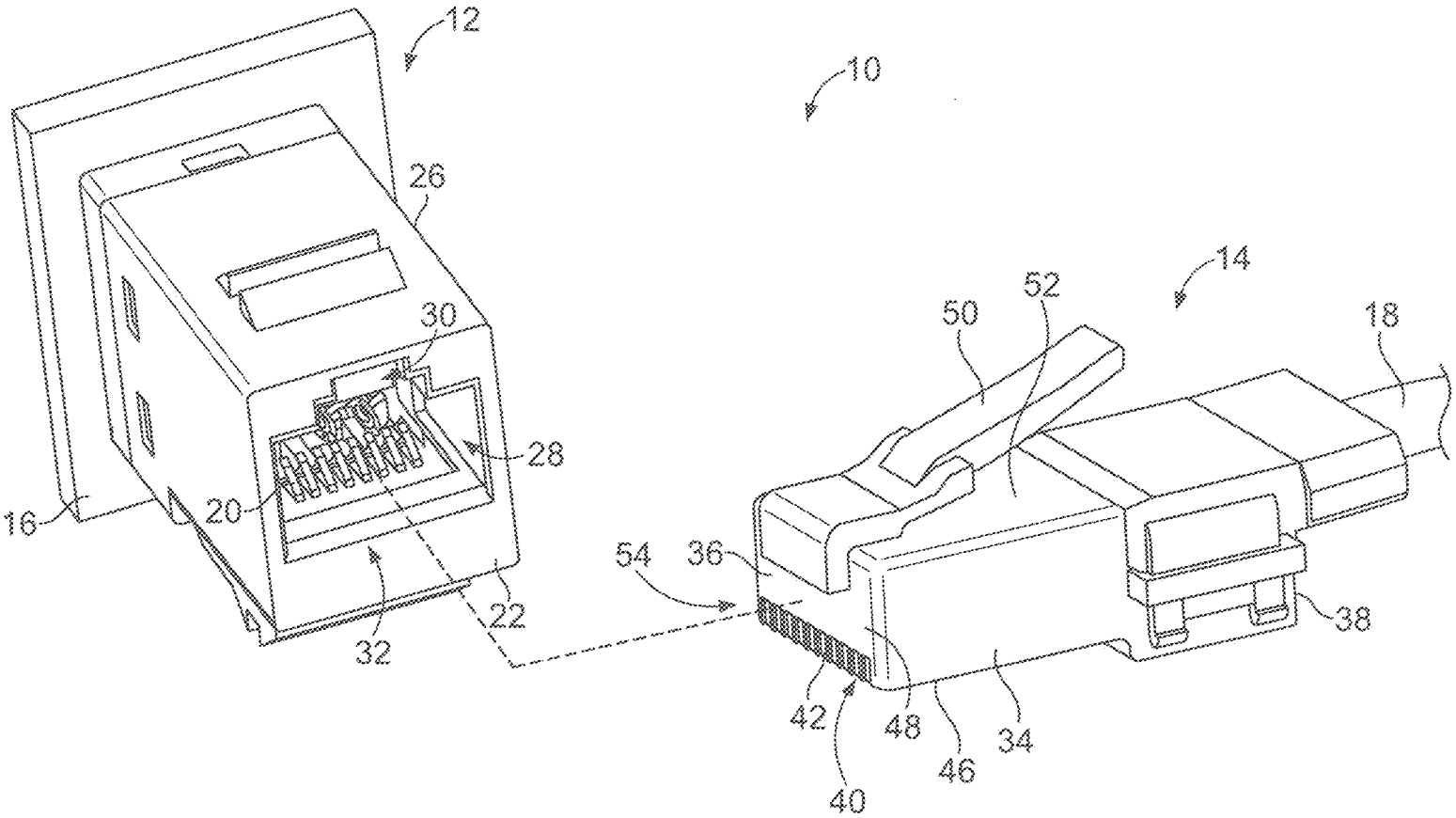
FIG. 1 is a perspective view of an electrical connector system formed in accordance with an exemplary embodiment.

FIG. 1 is a perspective view of an electrical connector system 10 formed in accordance with an exemplary embodiment. The electrical connector system 10 includes a modular jack 12 and a modular plug 14 configured to be mated with the jack 12. The jack 12 and plug 14 may be referred to hereinafter as electrical connector(s). In an exemplary embodiment, the jack 12 is provided on a substrate, such as a printed circuit board 16. The jack 12 may be mounted vertically on the printed circuit board 16, horizontally on the printed circuit board 16 or at other configurations. Optionally, the jack may be a right angle jack with the printed circuit board 16 perpendicular to the mating end. The jack 12 may be mounted on a wall or panel, or, alternatively, may be mounted in an electrical device or apparatus. Alternatively, the jack 12 may be wire or cable mounted at an end of a power cable. In an exemplary embodiment, the plug 14 is provided at an end of a power cable 18 that transmits power to/from the electrical connectors. The jack 12 may be configured as an in-line device, where the jack 12 and corresponding plug 14 are utilized to connect two cables. In an exemplary embodiment, the electrical connector system 10 is used as part of a power application for supplying power to and/or from devices connected to the jack 12 and/or plug 14.

The jack 12 and plug 14 will be described in terms of electrical connectors having components meeting certain requirements of industry standard type RJ-45 connectors, however the jack 12 and plug 14 may have some components that are outside of or do not comply with such industry standards. For example, the size, shape, position and configuration of certain components may comply with the standard, however the electrical connectors are used as power connectors rather than data connectors and thus may have different components to achieve power transmission. In an exemplary embodiment, the electrical connectors have eight contacts, however the eight contacts are used for power transmission rather than data transmission as is typical of RJ-45 connectors.

The jack 12 includes eight mating contacts 20 that are accessible at a mating end 22 to provide a connection interface for the printed circuit board 16. A housing 26 of the jack 12 may be mounted to the printed circuit board 16. In an exemplary embodiment, the eight mating contacts 20 are electrically commoned as part of one or more power circuits. For example, two power circuits may be provided with four mating contacts 20 in each power circuit. The mating contacts 20 are accessed through an opening 28 in the mating end 22 of the housing 26. A locking mechanism 30 extends into opening 28 that is configured to engage a portion of the plug 14 to retain the plug 14 within the jack 12.

In an exemplary embodiment, a mating interface 32 of the jack 12 defines an RJ-45 modular jack mating interface. The mating interface 32 is defined by features, such as, the size and shape of the opening 28, the positioning of the mating contacts 20 in the opening 28, the spacing of the mating contacts 20, the positioning of the locking mechanism 30, and the like.

The plug 14 has a plug housing 34 having a mating end 36 and a cable end 38. The plug housing 34, at the mating end 36, has a substantially similar cross section as the opening 28 of the jack 12. The mating end 36 is plugged into the opening 28 during mating of the plug 14 with the jack 12.

The plug housing 34 includes a plurality of contact slots 40 formed therein at the mating end 36. Plug contacts 42 are located in each of the contact slots 40. Each plug contact 42 is configured to make electrical contact with one of the mating contacts 20 when the plug 14 is inserted into the jack 12. In the illustrated embodiment, the plug 14 includes eight plug contacts 42 that are accessible at the mating end 36 to provide a connection interface for corresponding wires 44 (shown in FIG. 2) of the power cable 18. In an exemplary embodiment, the eight plug contacts 42 are electrically commoned as part of one or more power circuits. For example, two power circuits may be provided with four plug contacts 42 in each power circuit. The plug contacts 42 are accessible along a bottom 46 of the plug housing 34 and/or through a front 48 of the plug housing 34 for mating engagement with corresponding mating contacts 20 of the jack 12.

The plug 14 includes a latch 50 for latching the plug 14 to the jack 12, utilizing the locking mechanism 30 within the jack 12. The latch 50 extends from a top 52 of the plug housing 34 proximate to the mating end 36.

In an exemplary embodiment, a mating interface 54 of the plug 14 defines an RJ-45 modular plug mating interface. The mating interface 54 is defined by features, such as, the size and shape of the exterior of the plug housing 34 at the mating end 36, the positioning of the plug contacts 42 along the plug housing 34, the spacing of the plug contacts 42, the positioning of the latch 50, and the like.

It is to be understood that the benefits described herein are also applicable to other types of electrical connectors, having other standardized mating interfaces, which may carry fewer or greater numbers of contacts in alternative embodiments. The following description is therefore provided for illustrative purposes only and is but one potential application of the subject matter described herein.

Figure 2:
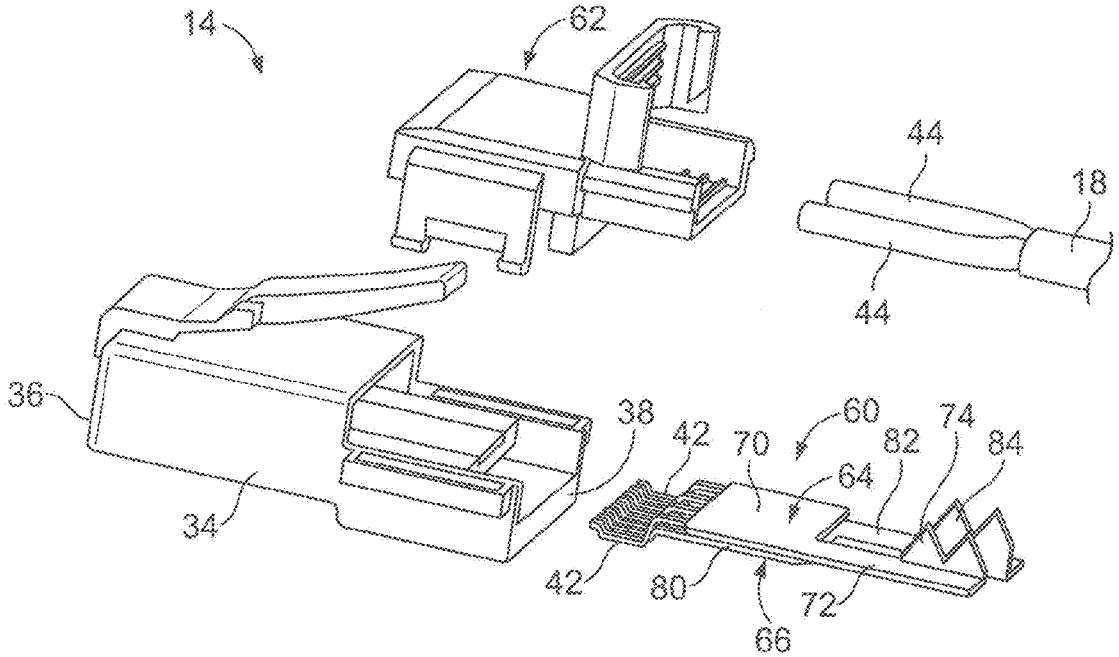
FIG. 2 is an exploded view of a plug for the electrical connector system shown in FIG. 1 and formed in accordance with an exemplary embodiment.

FIG. 2 is an exploded view of the plug 14 formed in accordance with an exemplary embodiment. The plug 14 includes the plug housing 34, a leadframe assembly 60 configured to be received in the plug housing 34 and a stuffer cap 62 configured to receive the wires 44 of the power cable 18 and configured to be coupled to the plug housing 34. The stuffer cap 62 is used to electrically connect the wires 44 to the leadframe assembly 60 during assembly. For example, the wires 44 may be pressed into electrical contact with the leadframe assembly 60 when the stuffer cap 62 is coupled to the plug housing 34. In the illustrated embodiment, the stuffer cap 62 is a separate component from the plug housing 34. The stuffer cap 62 is configured to be secured to the plug housing 34 to hold the wires 44 and the power cable 18 with respect to the plug housing 34 and the leadframe assembly 60. In an alternative embodiment, the stuffer cap 62 may be formed integral with the plug housing 34.

The leadframe assembly 60 is configured to be loaded into the plug housing 34. In an exemplary embodiment, the leadframe assembly 60 includes a first leadframe 64 and a second leadframe 66. The first and second leadframes 64, 66 form first and second power circuits for the plug 14. The first and second leadframes 64, 66 are configured to be connected to different wires 44 of the power cable 18.

In an exemplary embodiment, the first leadframe 64 defines a positive terminal of the plug 14 and the second leadframe 66 defines a negative terminal of the plug 14. Different groups of the plug contacts 42 are ganged together by the first and second leadframes 64, 66. For example, in an exemplary embodiment, the plug 14 includes 8 plug contacts 42 with four of the plug contacts 42 defining a first group of plug contacts 42 associated with the first leadframe 64 and four of the plug contacts 42 define a second group of plug contacts 42 that are associated with the second leadframe 66. In an exemplary embodiment, the first leadframe 64 and the second leadframe 66 are vertical stacked with the plug contacts 42 being internested at the mating end 36 of the plug housing 34 when assembled.

The first leadframe 64 includes a commoning pad 70, a plurality of the plug contacts 42 extending forward from the commoning pad 70 and a terminating leg 72 extending rearward from the commoning pad 70. The commoning pad 70 electrically commons the first group of plug contacts 42 together. In an exemplary embodiment, the plug contacts 42 are formed integral with the commoning pad 70. For example, the plug contacts 42 and the commoning pad 70 may be stamped from a metal sheet to form the leadframe.

The terminating leg 72 is positioned for terminating to the corresponding wire 44 of the power cable 18. In the illustrated embodiment, the terminating leg 72 includes spikes 74 that are configured to pierce the wire 44. The wire 44 may be a stranded wire conductor, or alternatively may be a solid conductor. Other types of terminating features may be provided in alternative embodiments for mechanically and electrically connecting the first leadframe 64 to the wire 44. For example, the terminating leg 72 may include an insulating displacement contact, a crimp barrel, a spring beam, or another type of terminating feature.

The second leadframe 66 includes a commoning pad 80, a plurality of the plug contacts 42 extending forward from the commoning pad 80 and a terminating leg 82 extending rearward from the commoning pad 80. The commoning pad 80 electrically commons the second group of plug contacts 42 together. In an exemplary embodiment, the plug contacts 42 are formed integral with the commoning pad 80. For example, the plug contacts 42 and the commoning pad 80 may be stamped from a metal sheet to form the leadframe.

The terminating leg 82 is positioned for terminating to the corresponding wire 44 of the power cable 18. In the illustrated embodiment, the terminating leg 82 includes spikes 84 that are configured to pierce the wire 44. The wire 44 may be a stranded wire conductor, or alternatively may be a solid conductor. Other types of terminating features may be provided in alternative embodiments for mechanically and electrically connecting the second leadframe 66 to the wire 44. For example, the terminating leg 82 may include an insulating displacement contact, a crimp barrel, a spring beam, or another type of terminating feature.

During assembly, the leadframe assembly 60 is loaded into the plug housing 34. For example, the leadframe assembly 60 may be loaded into the plug housing 34 through the cable end 38. Optionally, the first and second leadframes 64, 66 may be loaded into the plug hosing 34 together as a unit. Alternatively, the first and second leadframes 64, 66 may be separately and individually loaded into the plug housing 34. When the leadframe assembly 60 is loaded into the plug housing 34, the plug contacts 42 are arranged at the mating end 36 of the plug housing 34. The terminating legs 72, 82 are positioned proximate to the cable end 38 of the plug housing 34 for terminating to the wires 44.

Figure 3:
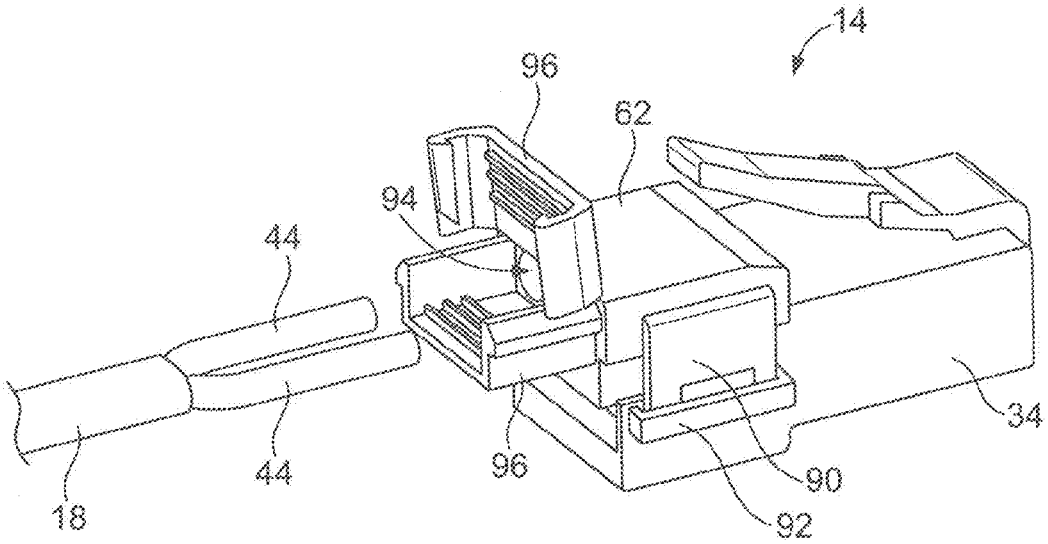
FIG. 3 is a rear perspective view of the plug in a pre-terminated assembled state.

FIG. 3 is a rear perspective view of the plug 14 in a pre-terminated assembled state. The stuffer cap 62 is aligned with the plug housing 34. Optionally, the stuffer cap 62 may be pre-staged in an open position with respect to the plug housing 34. In the pre-staged, open position, the stuffer cap 62 is coupled to the plug housing 34 and is movable with respect to the plug housing 34 in a closing direction such that the stuffer cap 62 may be moved to a closed position with respect to the plug housing 34. The pre-staged, open position allows the relative position of the stuffer cap 62 to be held with respect to the plug housing 34 wherein relative movement between the stuffer cap 62 and the plug housing 34 is controlled or limited in one or more predetermined direction. For example, from the pre-staged, open position, the stuffer cap 62 may be moved vertical downward after the wires 44 are loaded into the stuffer cap 62 to terminate the wires 44 to the leadframe assemblies 60 (shown in FIG. 2).

The stuffer cap 62 includes securing features 90 configured to engage corresponding securing features 92 of the plug housing 34. In the illustrated embodiment, the securing features 90 constitute clips or tabs extending from the stuffer cap 62. In the illustrated embodiment, the securing features 92 constitute openings that receive the securing features 90. The securing features 90, 92 are used to secure the stuffer cap 62 to the plug housing 34 in the pre-staged, open position and/or the closed position.

The stuffer cap 62 includes wire channels 94 that receive corresponding wires 44. The wires 44 are loaded into the wire channels 94 in a wire loading direction. Once the wires 44 are fully loaded into the wire channels 94 the stuffer cap 62 may be moved to the closed position. As the stuffer cap 62 is moved to the closed position, the stuffer cap 62 forces the wires 44 into electrical contact with the leadframe assembly 60 by forcing the spikes 74, 84 through insulation of the wires 44.

In an exemplary embodiment, the stuffer cap 62 includes a strain relief feature 96 used to provide strain relief for the power cable 18. In the illustrated embodiment, the strain relief feature 96 includes a lid or cover that may be closed tightly around the power cable 18 to provide strain relief between the power cable 18 and the plug 14. Other types of strain relief features may be provided in alternative embodiments.

Figure 4:
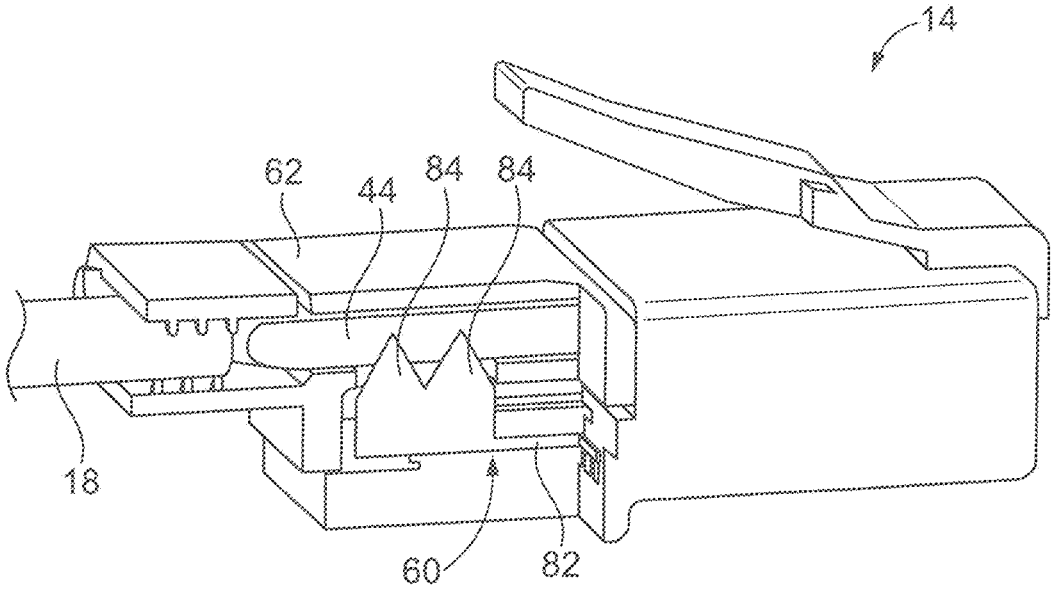
FIG. 4 is a cross sectional view of the plug and wire termination.

FIG. 4 is a cross sectional view of the plug 14 showing the leadframe assembly 60 electrically connected to the power cable 18. The spikes 84 of the terminating leg 82 are shown in FIG. 4 piercing the insulation of the wire 44 of the power cable 18. During assembly, as the stuffer cap 62 is pressed vertically downward toward the plug housing 34, the wires 44 are pressed into electrical contact with the spikes 84. The spikes 84 pierce through the insulation of the wire 44 to create an electrical connection with the conductor of the wire 44.

Figure 5:
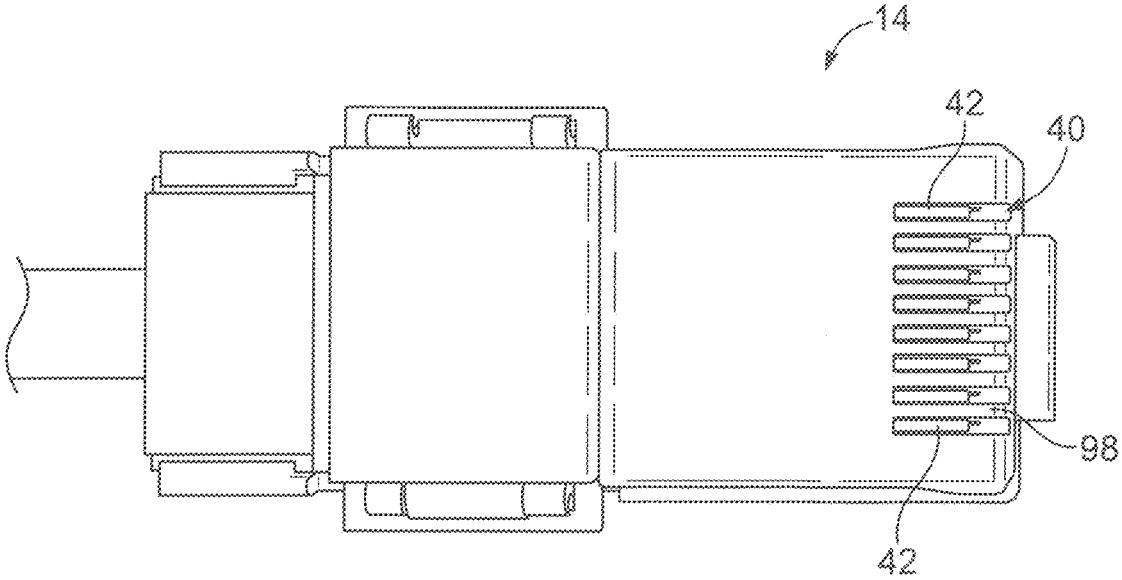
FIG. 5 is a bottom view of the plug.

FIG. 5 is a bottom view of the plug 14. The contact slots 40 and plug contacts 42 are illustrated in FIG. 5. In the illustrated embodiment, eight plug contacts 42 and eight contact slots 40 are provided. Separating walls 98 separate the contact slots 40. In an exemplary embodiment, the eight plug contacts 42 are arranged to define a RJ-45 modular plug connector interface.

Any of the plug contacts 42 may be ganged together depending on the particular application. In an exemplary embodiment, the plug contacts 42 at positions 1, 3, 5, 7 are electrically commoned together as part of the first leadframe 64 (shown in FIG. 2) while the plug contacts 42 at positions 2, 4, 6, 8 are electrically commoned together via the second leadframe 66 (shown in FIG. 2). Alternative configurations are possible in alternative embodiments, such as the plug contacts 42 at positions 1, 2, 3, 4, being electrically commoned while the plug contacts 42 at positions 5, 6, 7, 8 are electrically commoned together by a different leadframe. In other alternative embodiments, more than two leadframes and groups of contacts may be electrically commoned together. In other alternative embodiments, unequal numbers of plug contacts 42 may be electrically commoned by a leadframe. Having many plug contacts 42 electrically commoned together allows higher current caring capability for the plug 14, as compared to electrical connects where only one or two of the plug contacts carry current.

Figure 6:
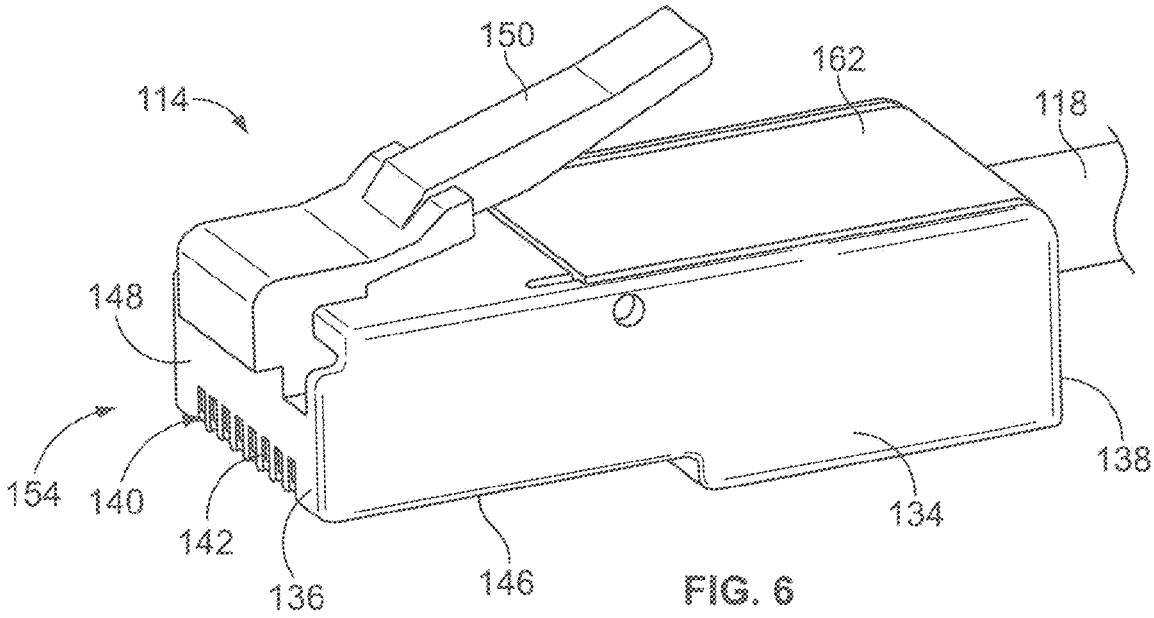
FIG. 6 is a perspective view of a plug formed in accordance with an exemplary embodiment.

FIG. 6 is a perspective view of a modular plug 114 formed in accordance with an exemplary embodiment. The modular plug 114 may be similar to the modular plug 14 (shown in FIG. 1) in some respects and may be mated with the modular jack 12 (shown in FIG. 1). The plug 114 is provided at an end of a power cable 118 that transmit power to/from the electrical connectors. The plug 114 meets certain requirements of industry standard type RJ-45 connectors. For example, the size, shape, position and configuration of certain components may comply with the standard, however the plug 114 is used as power connector rather than a data connector and thus may have different components to achieve power transmission.

The plug 114 has a plug housing 134 having a mating end 136 and a cable end 138. The plug housing 134 includes a plurality of contact slots 140 formed therein at the mating end 136. Plug contacts 142 are located in each of the contact slots 140. The plug contacts 142 may be substantially similar to the plug contacts 42 (shown in FIG. 2). The plug contacts 142 may be part of a leadframe assembly in a similar manner as the plug contacts 42. In an exemplary embodiment, the plug 114 includes the leadframe assembly 60 (shown in FIG. 2).

In the illustrated embodiment, the plug 114 includes eight plug contacts 142 that are accessible at the mating end 136 to provide a connection interface for corresponding wires 144 (shown in FIG. 7) of the power cable 118. In an exemplary embodiment, the eight plug contacts 142 are electrically commoned as part of one or more power circuits. For example, two power circuits may be provided with four plug contacts 142 in each power circuit. The plug contacts 142 are accessible along a bottom 146 of the plug housing 134 and/or through a front 148 of the plug housing 134 for mating engagement with corresponding the mating contacts 20 of the jack 12.

In an exemplary embodiment, a mating interface 154 of the plug 114 defines an RJ-45 modular plug mating interface. The mating interface 154 is defined by features, such as, the size and shape of the exterior of the plug housing 134 at the mating end 136, the positioning of the plug contacts 142 along the plug housing 134, the spacing of the plug contacts 142, the positioning of a latch 150, and the like.

The plug 114 includes a stuffer cap 162 configured to receive the wires 144 of the power cable 118 and configured to be coupled to the plug housing 134. The stuffer cap 162 is used to electrically connect the wires 144 to the leadframe assembly 60 of the plug 114 during assembly. For example, the wires 144 may be pressed into electrical contact with the leadframe assembly 60 when the stuffer cap 162 is coupled to the plug housing 134. In the illustrated embodiment, the stuffer cap 162 is pivotably coupled to the plug housing 134. The stuffer cap 162 may include pins or posts 164 extending into the plug housing 134 that operate as an axle for the stuffer cap 162. Alternatively, the stuffer cap 162 may be formed integral with the plug housing 134 and is connected thereto at a living hinge.

Figure 7:
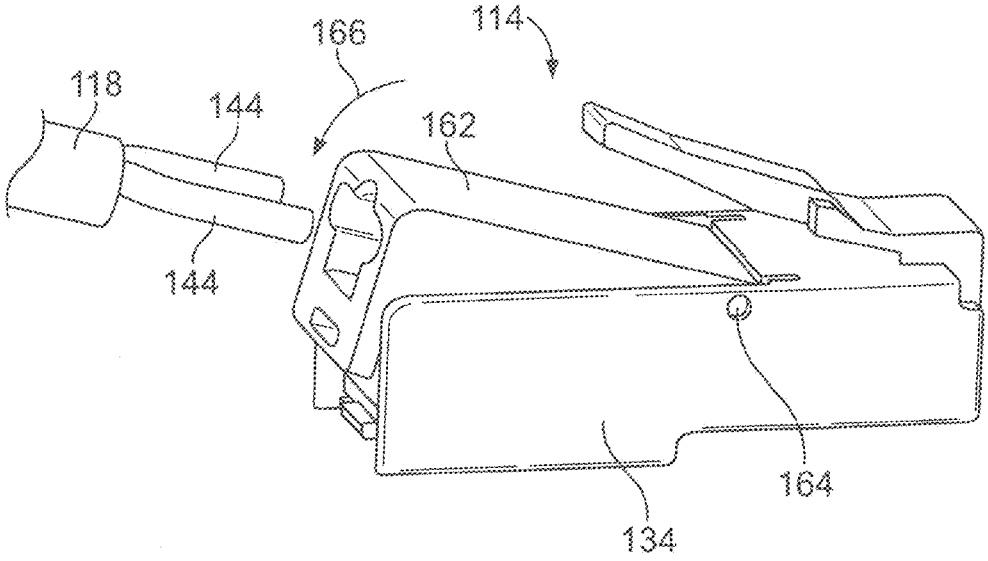
FIG. 7 is a rear perspective view of the plug in a pre-terminated assembled state.

FIG. 7 is a rear perspective view of the plug 114 in a pre-terminated assembled state. The stuffer cap 162 is partially opened to a pre-staged position with respect to the plug housing 134. The stuffer cap 162 is pivoted in a pivoting closing direction 166 once the wires 144 are loaded therein.

Plugs 14, 114 are provided that define power connectors having RJ-45 mating interfaces. The plug contacts 42, 142 are electrically commoned as part of leadframes that define power terminals of the plugs 14, 114. Having many plug contacts 42, 142 electrically commoned together allows higher current caring capability for the plugs 14, 114, as compared to electrical connects where only one or two of the plug contacts carry current.

Figure 8:
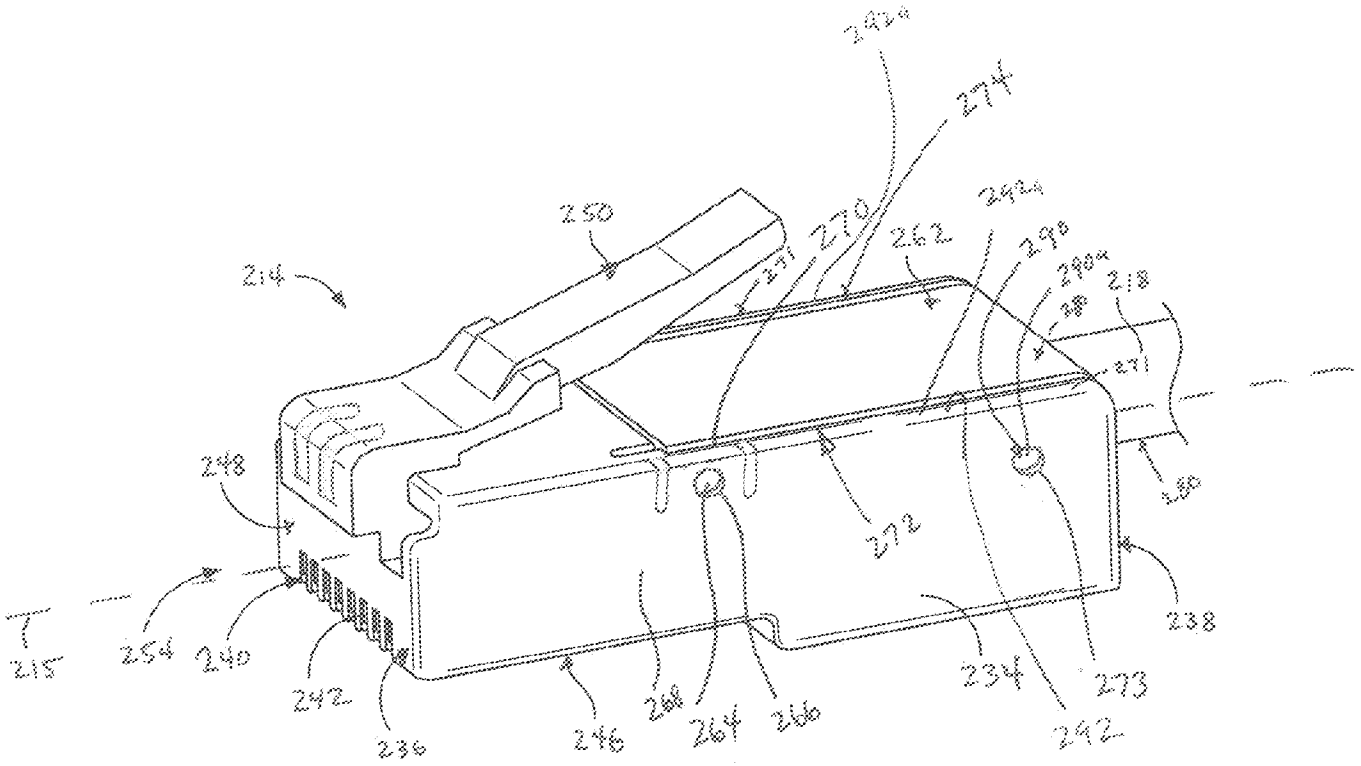
FIG. 8 is a perspective view of a plug formed in accordance with an exemplary embodiment.
Figure 9:
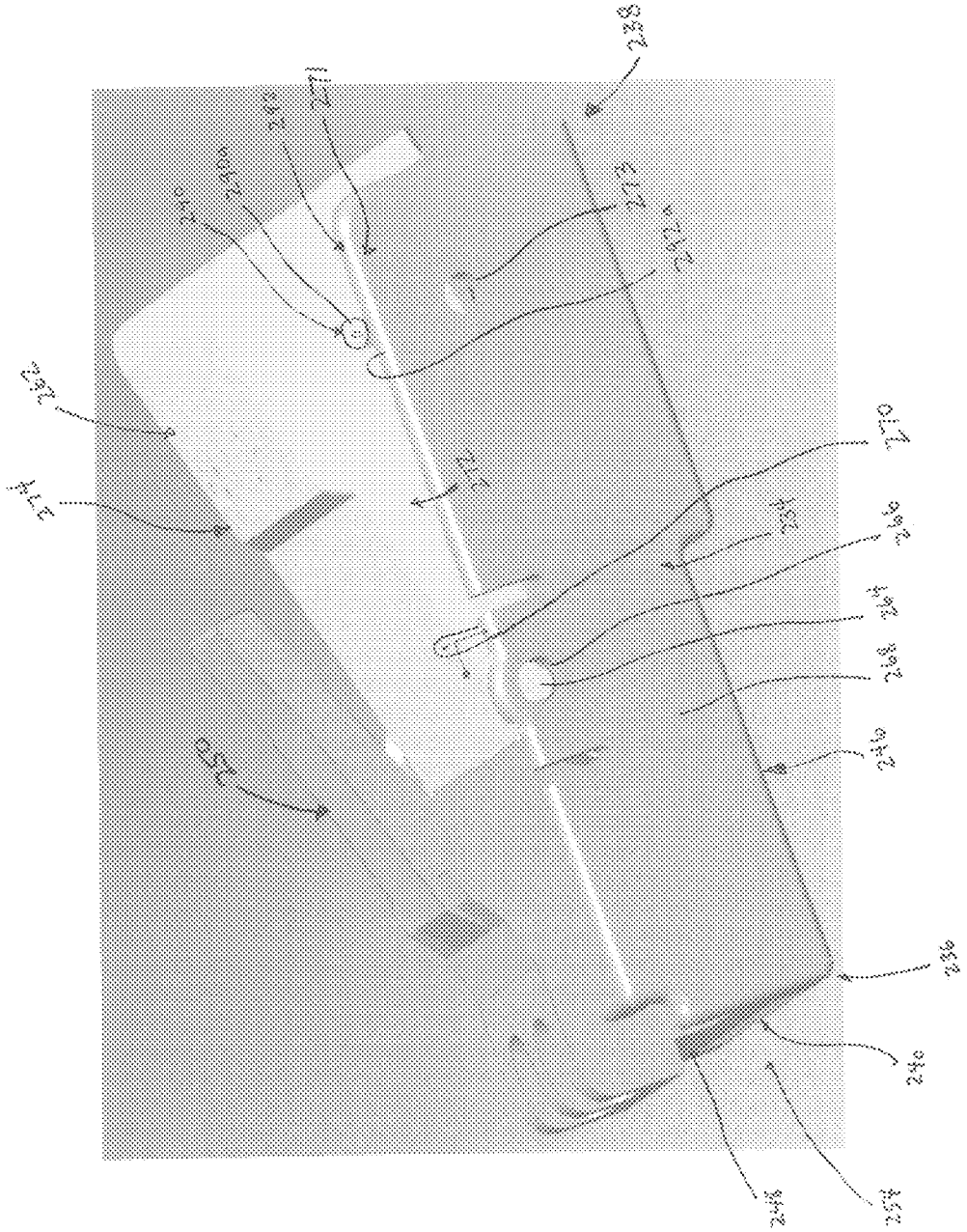
FIG. 9 is another perspective view of the plug shown in FIG. 8.

FIGS. 8 and 9 are perspective views of a modular plug 214 formed in accordance with an exemplary embodiment. The modular plug 214 includes an exemplary embodiment of a strain relief member 296 (shown in FIGS. 10-12). The modular plug 214 may be similar to the modular plug 114 (shown in FIGS. 6 and 7) and/or the modular plug 14 (shown in FIGS. 1-5) in some respects and may be mated with the modular jack 12 (shown in FIG. 1) along a connection axis 215 (not shown in FIG. 9). In the illustrated embodiment, the plug 214 is provided at an end 280 of a power cable 218 that transmits power to/from the electrical connectors. The power cable 218 is not shown in FIG. 9.

The plug 214 has a plug housing 234 having a mating end 236 and a cable end 238. The plug housing 234 includes a plurality of contact slots 240 formed therein at the mating end 236. Plug contacts 242 (not visible in FIG. 9) are located in each of the contact slots 240. The plug contacts 242 may be substantially similar to the plug contacts 42 (shown in FIGS. 1, 2, and 5) and/or the plug contacts 142 (shown in FIG. 6). The plug contacts 242 may be part of a leadframe assembly in a similar manner as the plug contacts 42. In the illustrated embodiment, the plug 214 includes a leadframe assembly 260 (shown in FIG. 10).

In the illustrated embodiment, the plug 214 includes eight plug contacts 242 that are accessible at the mating end 236 to provide a connection interface for corresponding wires 244 (shown in FIGS. 10-12) of the power cable 218. In an exemplary embodiment, the eight plug contacts 242 are electrically commoned as part of one or more power circuits. For example, two power circuits may be provided with four plug contacts 242 in each power circuit. The plug contacts 242 are accessible along a bottom 246 of the plug housing 234 and/or through a front 248 of the plug housing 234 to define a mating interface 254 of the plug 214 where the plug contacts 242 mate with (i.e., matingly engage) the corresponding mating contacts 20 (shown in FIG. 1) of the jack 12.

The plug 214 may meet certain requirements of industry standard type RJ-45 connectors. For example, the size, shape, position and configuration of certain components may comply with the standard. In an exemplary embodiment, the mating interface 254 of the plug 214 defines an RJ-45 modular plug mating interface. The mating interface 254 is defined by features, such as, the size and shape of the exterior of the plug housing 234 at the mating end 236, the positioning of the plug contacts 242 along the plug housing 234, the spacing of the plug contacts 242, the positioning of a latch 250, and the like.

The plug 214 is not limited to meeting certain requirements of industry standard type RJ-45 connectors. Rather, the plug 214 may be any type of modular plug that meets certain requirements of any industry standard(s). Moreover, the illustrated embodiment of the plug 214 is used as a power connector rather than a data connector and therefore may have different components to achieve power transmission. But, the plug 214 is not limited to being used as a power connector. Rather, the plug 214 may transmit data signals in addition or alternative to transmitting power, no matter which type of modular plug the plug 214 is and which industry standard(s) the plug 214 conforms to. For example, although described as a "power cable", the cable 218 may additionally or alternatively transmit data signals. In some embodiments, the plug 214 does not transmit power.

The plug 214 includes a stuffer cap 262 configured to receive the wires 244 of the power cable 218 and configured to be coupled to the plug housing 234. The stuffer cap 262 is used to electrically connect the wires 244 to the leadframe assembly 260 of the plug 214 during assembly. For example, the wires 244 may be pressed into electrical contact with the leadframe assembly 260 when the stuffer cap 262 is coupled to the plug housing 234. In the illustrated embodiment, the stuffer cap 262 is pivotably coupled to the plug housing 234 such that the stuffer cap 262 is pivotable between a pre-staged position and a closed position with respect to the plug housing 234. The stuffer cap 262 is shown in the closed position in FIGS. 8 and 12. The stuffer cap 262 is shown in the pre-staged position in FIGS. 9-11. In the pre-staged position, the stuffer cap 262 is positioned for insertion of the power cable 218 into a cable channel 282 (shown in FIGS. 10-12) of the stuffer cap 262 prior to closing the stuffer cap 262 for termination of the power cable 218. Optionally, the plug 214 may be shipped to a customer in the pre-staged position.

One or more pivot pins and/or one or more pivot posts may extend into one or more corresponding openings of the plug housing 234 to operate as an axle for the pivoting action of the stuffer cap 262. In the illustrated embodiment, the stuffer cap 262 includes opposite pivot posts 264 (only one is visible in FIGS. 8 and 9) that extend into corresponding opposite openings 266 (only one is visible in FIGS. 8 and 9) of the plug housing 234. The stuffer cap 262 is configured to pivot about the pivot posts 264 to pivot between the pre-staged and closed positions. Of course, the arrangement of one or more of the pivot posts 264 and the corresponding opening 266 could be reversed such that the plug housing 234 includes the pivot post 264 and the stuffer cap 262 includes the corresponding opening 266. Although shown as extending through an exterior side 268 of the plug housing 234, each opening 266 may alternatively not extend through the side 268. In other words, each opening 266 may be a notch that extends into an interior side 270 of a corresponding wall 271 of the plug housing 234 but does not extend completely through the wall 271. Likewise, any openings 266 that extend into the stuffer cap 262 may not extend completely through the stuffer cap 262 from the side 272 to the side 274.

One example of using one or more pivot pins includes providing a single pivot pin (not shown) that extends through the stuffer cap 262 and has opposite ends that extend into the opposite openings 266 of the plug housing 234. In addition or alternatively to any pivot posts 264 and/or any pivot pins, the stuffer cap 262 may be formed integral with the plug housing 234 and connected thereto at a living hinge that enables the pivoting action of the stuffer cap 262.

The stuffer cap 262 includes securing features 290 configured to engage corresponding securing features 292 of the plug housing 234 to secure the stuffer cap 262 in the pre-staged position relative to the plug housing 234. In the illustrated embodiment, the securing features 90 constitute embossments 290*a* (only one is shown herein) that extend outward from opposite sides 272, 274 of the stuffer cap 262. The securing features 292 of the plug housing 234 constitute ledges 292*a* (only one is visible in FIG. 9) of the walls 271. The embossments 290*a* are configured to be snapped over the corresponding ledges 292*a* to secure the stuffer cap 262 in the pre-staged position. For example, the walls 172 may deflect to enable the embossments 290*a* to clear the ledges 292*a* and thereby snap over the ledges 292*a*. Of course, the arrangement of one or more of the embossments 290*a* and the corresponding ledge 292*a* could be reversed such that the plug housing 234 includes the embossment 290*a* and the stuffer cap 262 includes the corresponding ledge 292*a*. The stuffer cap 262 may include any number of the securing features 290 and the plug housing 234 may include any number of the securing features 292. Moreover, in some alternative embodiments, the plug 214 does not include any securing features for securing the stuffer cap 262 in the pre-staged position and a user or a machine holds the stuffer cap in the pre-staged position during insertion of the power cable 218 into the stuffer cap 262.

The plug housing 234 optionally includes one or more openings 273 that receive the embossments 292*a* therein when the stuffer cap 262 is in the closed position, as is shown in FIG. 8. The openings 273 enable the walls 271 of the plug housing 234 to be undeflected (i.e., at the natural resting position thereof) when the stuffer cap 262 is in the closed position. Optionally, reception of the embossments 292*a* within the openings 273 may secure the stuffer cap 262 in the closed position, for example in addition or alternatively to the securing features 291, 293 (shown in FIGS. 10-12) described below. Although shown as extending through the exterior side 268 of the plug housing 234, each opening 273 may alternatively not extend through the side 268 (i.e., each opening 273 may be a notch that extends into the interior side 270 of the corresponding wall 271 but does not extend completely through the wall 271).

Other arrangements may additionally or alternatively be used to secure the stuffer cap 262 in the pre-staged position. For example, the securing features 290, 292 are not limited to using the snap-fit connection, but rather may use any other type of connection, such as, but not limited to, using an interference-fit (i.e., press-fit) connection, using stiction between the stuffer cap 262 and the plug housing 234 (e.g., at the pivot axle), using a latch-type connection, using a threaded connection, and the like. Moreover, the securing features 290, 292 are not limited to the respective embossments 290*a* and ledges 292*a*, but rather may additionally or alternatively include any other type of connection structure, such as, but not limited to, a tab, a notch, a post, an opening, a latch, a clip, a clamp, a threaded fastener, and the like.

Figure 10:
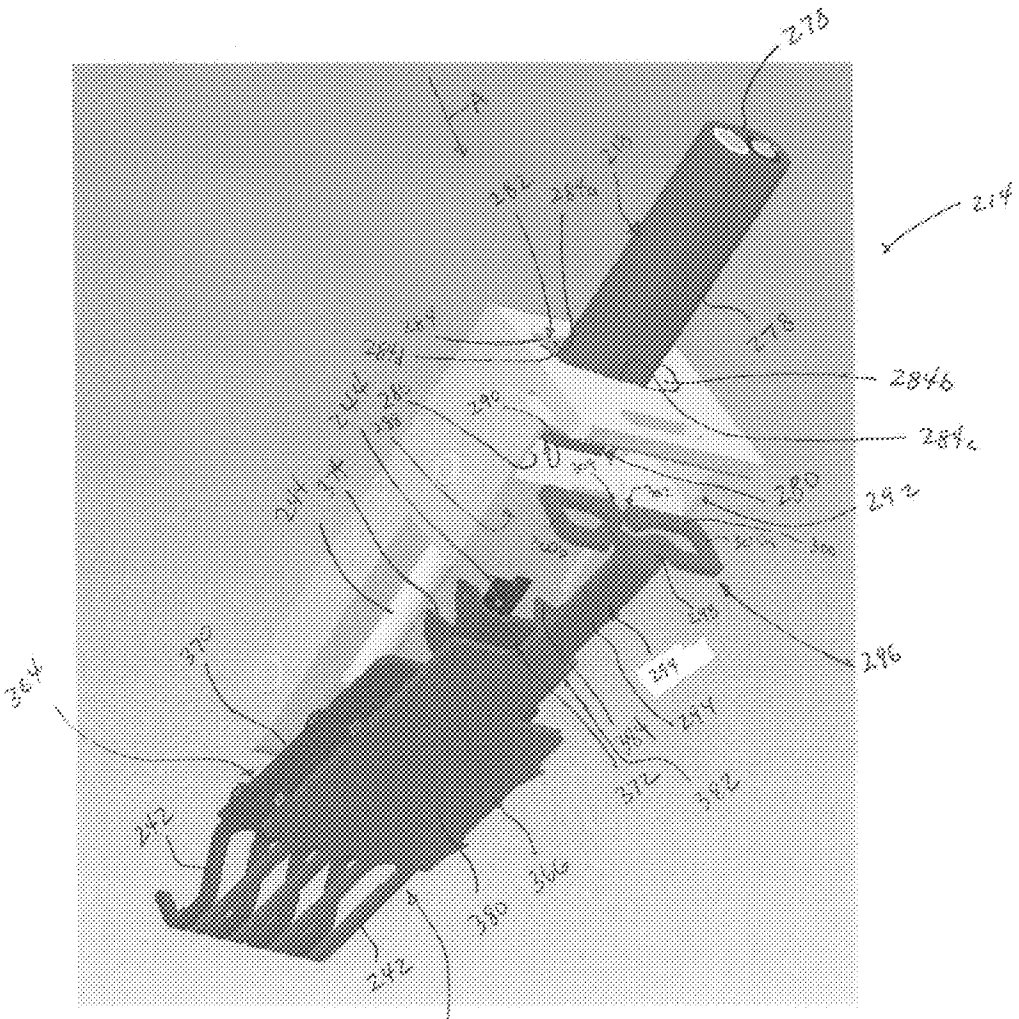
FIG. 10 is a perspective view of a portion of the plug shown in FIGS. 8 and 9.
Figure 11:
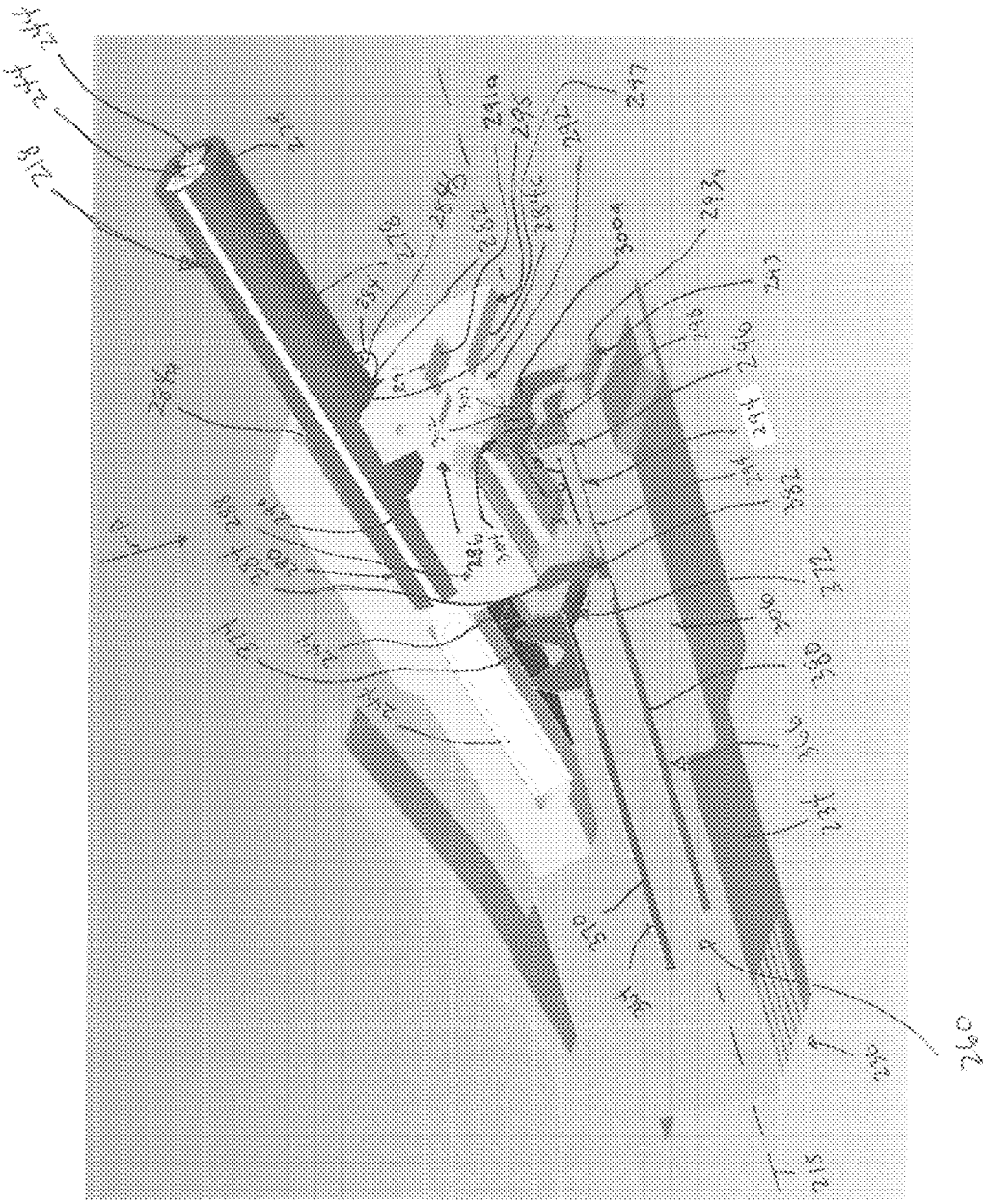
FIG. 11 is a cross-sectional view of the portion of the plug shown in FIG. 10.

FIGS. 10 and 11 are perspective and cross-sectional views, respectively, of a portion of the plug 214. The plug housing 234 has been removed from FIG. 10 for clarity. The power cable 218 includes the wires 244 and an insulative jacket 278 that holds the wires 244. The power cable 218 includes an end 280. In the illustrated embodiment, the power cable 218 includes two of the wires 244. But, the power cable 218 may include any number of the wires 244. Each wire 244 of the power cable 218 may be a stranded wire conductor, or alternatively may be a solid conductor.

As described above, the plug 214 includes the leadframe assembly 260. In the illustrated embodiment, the leadframe assembly 260 includes two leadframes, namely a first leadframe 364 and a second leadframe 366. The first and second leadframes 364, 366 form first and second power circuits for the plug 214. The first and second leadframes 364, 366 are configured to be connected to different wires 244 of the power cable 218. Although two are shown and described herein, the leadframe assembly 260 may include any number of leadframes.

In an exemplary embodiment, the first leadframe 364 defines a positive terminal of the plug 214 and the second leadframe 366 defines a negative terminal of the plug 214. Different groups of the plug contacts 242 (not visible in FIG. 11) are ganged together by the first and second leadframes 364, 366. For example, in an exemplary embodiment, the plug 214 includes 8 plug contacts 242 with four of the plug contacts 242 defining a first group of plug contacts 242 associated with the first leadframe 364 and four of the plug contacts 242 define a second group of plug contacts 242 that are associated with the second leadframe 366. In an exemplary embodiment, the first leadframe 364 and the second leadframe 366 are vertically stacked with the plug contacts 242 being internested at the mating end 236 (shown in FIGS. 8, 9, and 11) of the plug housing 234 when assembled.

The first leadframe 364 includes a commoning pad 370, a plurality of the plug contacts 242 extending forward from the commoning pad 370 and a terminating leg 372 extending rearward from the commoning pad 370. The commoning pad 370 electrically commons the first group of plug contacts 242 together. In an exemplary embodiment, the plug contacts 242 are formed integral with the commoning pad 370. For example, the plug contacts 242 and the commoning pad 370 may be stamped from a metal sheet to form the first leadframe 364.

The terminating leg 372 is positioned for terminating to the corresponding wire 244 of the power cable 218. In the illustrated embodiment, the terminating leg 372 includes spikes 374 that are configured to pierce the wire 244. Other types of terminating features may be provided in alternative embodiments for mechanically and electrically connecting the first leadframe 364 to the wire 244. For example, the terminating leg 372 may include an insulating displacement contact, a crimp barrel, a spring beam, or another type of terminating feature.

The second leadframe 366 includes a commoning pad 380, a plurality of the plug contacts 242 extending forward from the commoning pad 380 and a terminating leg 382 extending rearward from the commoning pad 380. The commoning pad 380 electrically commons the second group of plug contacts 242 together. In an exemplary embodiment, the plug contacts 242 are formed integral with the commoning pad 380. For example, the plug contacts 242 and the commoning pad 380 may be stamped from a metal sheet to form the leadframe.

The terminating leg 382 is positioned for terminating to the corresponding wire 244 of the power cable 218. In the illustrated embodiment, the terminating leg 382 includes spikes 384 that are configured to pierce the wire 244. Other types of terminating features may be provided in alternative embodiments for mechanically and electrically connecting the second leadframe 366 to the wire 244. For example, the terminating leg 382 may include an insulating displacement contact, a crimp barrel, a spring beam, or another type of terminating feature.

Referring now solely to FIG. 11, the stuffer cap 262 and plug housing 234 may include the securing features 291, 293, respectively, for securing the stuffer cap 262 in the closed position relative to the plug housing 234. In the illustrated embodiment, the securing feature 291 of the stuffer cap 262 is a window 291*a* that extends into the stuffer cap 262. The securing feature 293 of the plug housing 234 constitutes an embossment 293*a* that is configured to be received into the window 291*a* with a snap-fit connection to secure the stuffer cap 262 in the closed position. Of course, the arrangement of the embossment 293*a* and the corresponding window 291*a* could be reversed such that the plug housing 234 includes the embossment 293*a* and the stuffer cap 262 includes the window 291*a*. Although shown as extending completely through a wall 295 of the stuffer cap 262, the window 291*a* may alternatively not extend completely through the wall 295 (i.e., the window 291*a* may be a notch that extends into an interior side 297 of the wall 295 but does not extend completely through the wall 295). Likewise, any windows 291*a* that extend into the plug housing 234 may not extend completely through the corresponding wall of the plug housing 234. The stuffer cap 262 may include any number of the securing features 291 and the plug housing 234 may include any number of the securing features 293.

Other arrangements may additionally or alternatively be used to secure the stuffer cap 262 in the closed position. For example, the securing features 291, 293 are not limited to using the snap-fit connection, but rather may use any other type of connection, such as, but not limited to, using an interference-fit (i.e., press-fit) connection, using stiction between the stuffer cap 262 and the plug housing 234 (e.g., at the pivot axle), using a latch-type connection, using a threaded connection, and the like. Moreover, the securing features 291, 293 are not limited to the respective window 291*a* and embossment 293*a*, but rather may additionally or alternatively include any other type of connection structure, such as, but not limited to, a tab, a notch, a post, a ledge, a latch, a clip, a clamp, a threaded fastener, and the like.

Referring again to FIGS. 10 and 11, the stuffer cap 262 includes a cable channel 282 that is configured to receive the end 280 of the power cable 218 therein. The cable channel 282 is defined by one or more interior sides 284 of the stuffer cap 262. In the illustrated embodiment, the cable channel 282 has the general cross-sectional shape of an oval (best seen in FIG. 12) such that the cable channel 282 is defined by four interior sides 282*a*, 282*b*, 282*c*, 282*d* of the stuffer cap 262. The interior side 282*d* is not shown in FIG. 11. Each interior side 282*a-d* defines a portion of the cable channel 282. In other words, each interior side 282*a-d* defines a segment of the cross-sectional perimeter of the cable channel 282. The cable channel 282 is not limited to the oval cross-sectional shape shown and described herein. Rather, the cable channel 282 may have any other cross-sectional shape and may be defined by any number of interior sides 282 of the stuffer cap 262. In some embodiments, the cable channel 282 is defined by a single interior side 282 of the stuffer cap 262 that defines an approximate entirety of the cross-sectional perimeter of the cable channel 282. Moreover, the cable channel 282 may have any size and shape (e.g., any cross-sectional size and cross-sectional shape) for receiving a cable having any size and shape. In some embodiments, the size and/or shape of the cable channel 282 is configured such that the cable channel 282 is configured to receive a variety of different cable sizes and/or shapes therein.

The stuffer cap 262 includes a slot 286 that extends through the stuffer cap 262 into the cable channel 282. Specifically, the slot 286 extends through a wall 288 of the stuffer cap 262 that includes the interior side 284*c*. The slot 286 extends through the interior side 284*c* of the wall 288 such that an end 290 of the slot 286 communicates with the cable channel 282. The slot 286 extends completely through the wall 288 such that an opposite end 292 of the slot is open. As will be described below, the slot 286 is configured to receive a portion of the strain relief member 296 therein to enable the strain relief member 296 to engage the power cable 218 when the stuffer cap is pivoted to the closed position. Although shown as having the general cross-sectional shape of a rectangle, the slot 286 may have any other shape (and may have any size) that enables the slot 286 to receive the strain relief member 296 such that the strain relief member 296 engages the power cable 218.

As briefly described above, the plug 214 includes the strain relief member 296. The strain relief member 296 is optionally integrally formed with at least one of the plug contacts 242. In the illustrated embodiment, the strain relief member 296 is integrally formed with the leadframe 366. For example, the strain relief member 296, the second group of plug contacts 242, and the commoning pad 380 may be stamped from a sheet of material as an integral structure to form the leadframe 366 and strain relief member 296. In some alternative embodiments, the strain relief member 296 is integrally formed with the leadframe 364. Moreover, in some other alternative embodiments, the strain relief member 296 is integrally formed with the plug housing 234. For example, the strain relief member 296 and the plug housing 234 may be fabricated using the same mold.

The strain relief member 296 is held by the plug housing 234. In the illustrated embodiment, the leadframe 366 is held by the plug housing 234 such that the strain relief member 296 is held by the plug housing 234. In embodiments wherein the strain relief member 296 is formed integrally with the plug housing 234, the strain relief member 296 is considered to be held by the plug housing 234.

In the illustrated embodiment, the strain relief member 296 extends outward from the commoning pad 380 of the leadframe 366. Specifically, the strain relief member 296 includes a bridge 294 that extends outward from the commoning pad 380 to a base 298 of the strain relief member 296. But, the strain relief member 296 may additionally or alternatively extend from any other portion of the leadframe 366, for example one or more of the plug contacts 242.

The strain relief member 296 includes the base 298. One or more spring beams 300 are cantilevered from the base 298. Specifically, each spring beam 300 extends from the base 298 such that the spring beam 300 is cantilevered from the base 298. In the illustrated embodiment, the strain relief member 296 includes two spring beams 300*a*, 300*b*. But, the strain relief member 296 may include any number of the spring beams 300. As will be described below, the spring beams 300 are configured to engage the power cable 218 and thereby pinch the power cable 218 between the sniffer cap 262 and the spring beams 304. Each of the spring beams 300*a*, 300*b* may be referred to herein as a "first" and/or a "second" spring beam.

The spring beam 300*a* extends from the base 298 to an end 302 of the spring beam 300*a*. The spring beam 300*b* extends from the base 298 to an end 304 of the spring beam 300*a*. As can be seen in FIGS. 10 and 11, the spring beams 300*a*, 300*b* extend from the base 298 such that the ends 302, 304 generally oppose (i.e., face) each other. In the illustrated embodiment, the ends 302, 304 are free ends. But, alternatively the ends 302, 304 may be mechanically connected together (e.g., integrally formed or separately formed and thereafter mechanically connected together).

The spring beams 300 are resilient springs that are configured to be deflected as the spring beams 300 are engaged with the power cable 218. In the illustrated embodiment, the ends 302, 304 of the spring beams 300*a*, 300*b* are configured to deflect in the direction of the arrow A, whether or not the ends 302, 304 are mechanically connected to each other. As can be seen in FIG. 11, the direction A is oriented such that the ends 302, 304 of the spring beams 300*a*, 300*b*, respectively, are configured to deflect generally toward the base 298 of the strain relief member 296 and generally toward a base 306 of the plug housing 234. Optionally, the ends 302, 304 are configured to deflect a great enough distance such that the ends 302, 304 engage in physical contact with the base 298 of the strain relief member 296.

The spring beams 300 are optionally angled relative to the connection axis 215 (not shown in FIG. 10) in a direction generally toward the mating end 236 of the plug housing 234. For example, as shown in FIG. 11, the spring beams 300*a*, 300*b* are angled at an acute angle $\alpha$ relative to the connection axis 215. The acute angle $\alpha$ may have any value, such as, but not limited to, between approximately 60° and approximately 85°, less than approximately 86°, and the like. In embodiments wherein the spring beams 300 are angled toward the mating end 236 of the plug housing 234, the spring beams 300 will deflect slightly toward the mating end 236 as the spring beams 300 engage the power cable 218. The angle $\alpha$ may be small enough such that the spring beams 300 do not engage the base 298 even when the spring beams 300 deflect by a great enough amount in the direction A to engage the base 298 (i.e., the spring beams 300 will overlap the base 298 instead of engaging the base 298).

Assembly of the plug 214 will now be described. The power cable 218 can be loaded into the cable channel 282 of the stuffer cap 262 when the stuffer cap 262 is in the pre-staged position shown in FIGS. 10 and 11. Once the end 280 of the power cable 218 is fully received into the cable channel 282, the stuffer cap 262 can be pivoted from the pre-staged position to the closed position. As the stuffer cap 262 is moved to the closed position, the stuffer cap 262 forces the wires 244 into electrical contact with the leadframe assembly 60 by forcing the spikes 374, 384 through insulation of the wires 244.

Figure 12:
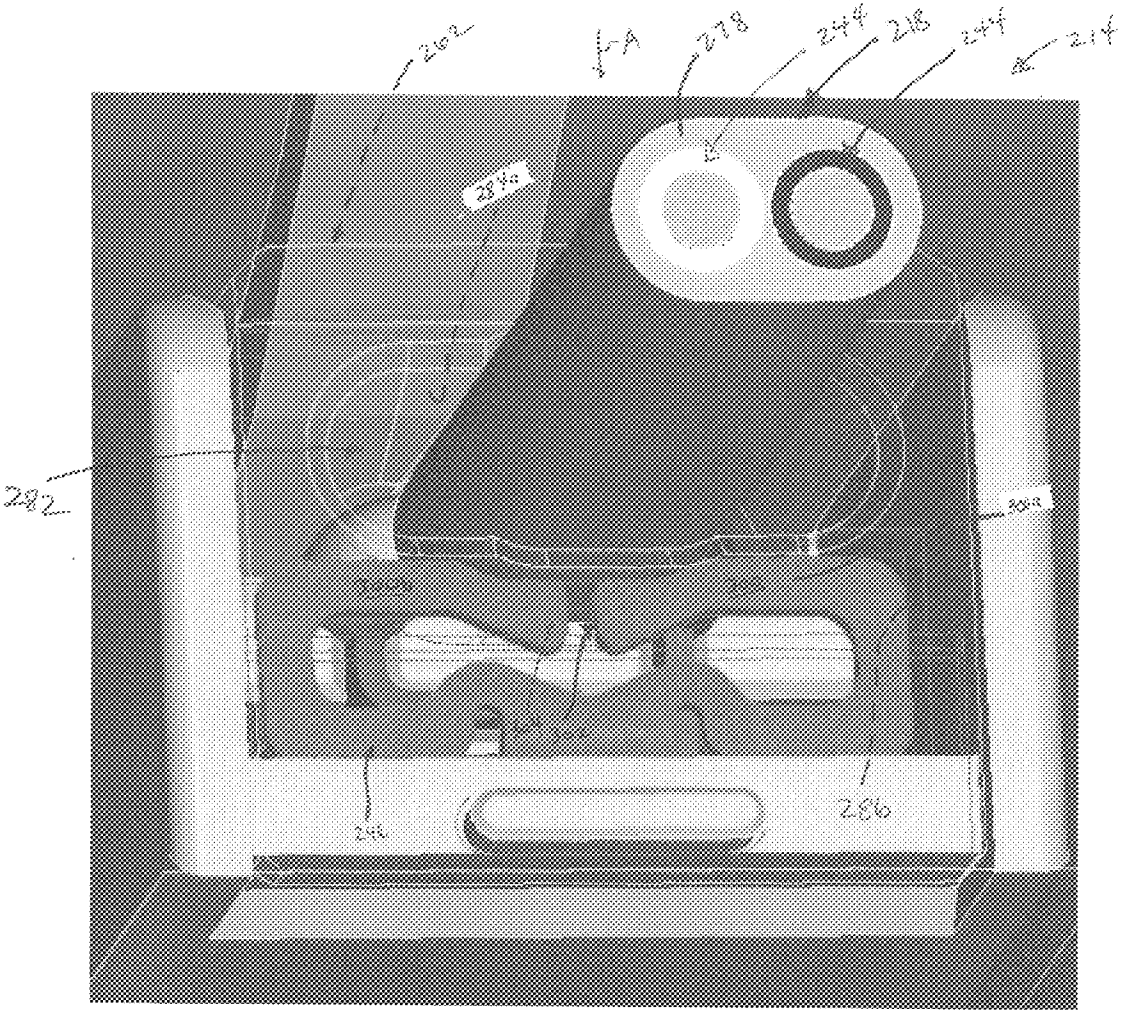
FIG. 12 is a perspective view illustrating the plug shown in FIGS. 8-11 as assembled.

FIG. 12 is a perspective view illustrating the plug 214 as assembled. The stuffer cap 262 is shown in phantom lines in FIG. 12 for clarity. Referring now to FIGS. 11 and 12, as the stuffer cap 262 is pivoted from the pre-staged position to the closed position, the spring beams 300 of the strain relief member 296 are received into the slot 286 of the stuffer cap 262. Specifically, the spring beams 300 extend into the slot 286 and into engagement in physical contact with the insulative jacket 278 of the power cable 218 as the stuffer cap 262 is pivoted to the closed position. Referring now solely to FIG. 12, each spring beam 300*a*, 300*b* is shown as engaged with the insulative jacket 278 of the power cable 218. The engagement of the spring beams 300 with the insulative jacket 278 as the stuffer cap 262 is pivoted to the closed position causes the ends 302, 304 of the spring beams 300 to deflect, against the bias thereof, in the direction of the arrow A. The spring beams 300 thus pinch the power cable 218 between the interior side 284*a* of the stuffer cap 262 and the spring beams 300. The spring beams 300 may also deflect slightly toward the mating end 236 (shown in FIGS. 8, 9, and 11) of the plug housing 234, which may provide a strain relief force in a direction generally opposite typical cable pull forces.

The natural bias of the spring beams 300 against the deflection applies a pinching force to the power cable 218 that pinches the power cable 218 between the spring beams 300 and the interior side 284*a* of the stuffer cap 262. The pinching force provides the power cable 218 with strain relief. The natural biasing forces of the spring beams 300 that act against deflection of the spring beams 300 may be selected to provide a predetermined pinching force, which may have any value. Optionally, the predetermined pinching force is selected such that the power cable 218 is at least partially compressed between the interior side 284*a* and the spring beams 300. The power cable 218 may be compressed by any amount. Moreover, the predetermined pinching force may be selected such that the insulative jacket 278 of the power cable 218 is not cut (e.g., penetrated) by the spring beams 300 and/or the interior side 284*a*.

The deflection of the spring beams 300 may enable the strain relief member 296 to provide strain relief to a variety of different cable sizes and/or shapes. For example, the deflection of the spring beams 300 may enable the same strain relief member 296 to be used with two or more different cables 218 that have different sizes than each other. Moreover, the deflection of the spring beams 300 may enable the strain relief member 296 to provide strain relief to a variety of different cable sizes and/or shapes without cutting the insulative jackets of the cables. Each spring beam 300 may deflect by any amount and may have any natural biasing force that enables the strain relief member 296 to provide strain relief to a cable.

Plugs 14, 114, 214 are provided that define power connectors having RJ-45 mating interfaces. The plug contacts 42, 142, 242 may be electrically commoned as part of leadframes that define power terminals of the plugs 14, 114, 214. Having many plug contacts 42, 142, 242 electrically commoned together allows higher current caring capability for the plugs 14, 114, 214 as compared to electrical connects where only one or two of the plug contacts carry current.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A modular plug comprising:

a plug housing;

plug contacts held by the plug housing;

a stuffer cap coupled to the plug housing, the stuffer cap comprising a cable channel configured to receive a cable therein, the stuffer cap comprising an interior side that defines at least a portion of the cable channel; and a strain relief member held by the plug housing, the strain relief member comprising a base and a spring beam extending from the base such that the spring beam is cantilevered from the base, wherein the spring beam is configured to engage the cable and thereby pinch the cable between the interior side of the stuffer cap and the spring beam, wherein the strain relief member is integrally formed with at least one of the plug contacts.

2. The modular plug of claim 1, wherein the spring beam is configured to be deflected in a direction generally toward a base of the plug housing as the spring beam is engaged with the cable.

3. The modular plug of claim 1, wherein the spring beam is a first spring beam, the strain relief member further comprising a second spring beam cantilevered from the base of the strain relief member such that the first and second spring beams oppose each other.

4. The modular plug of claim 1, wherein the stuffer cap is pivotally coupled to the plug housing such that the stuffer cap is configured to press wires of the cable into electrical contact with the plug contacts when the stuffer cap is pivoted to a closed position, the stuffer cap comprising a slot that extends through the stuffer cap into the cable channel, the slot being configured to receive the spring beam of the strain relief member therein as the stuffer cap is pivoted to the closed position such that the spring beam extends into the slot and into engagement with the cable.

5. The modular plug of claim 1, further comprising a leadframe that includes a group of the plug contacts that are electrically commoned with each other by a commoning pad, the strain relief member extending outward from the commoning pad.

6. The modular plug of claim 1, further comprising a leadframe that includes a group of the plug contacts that are electrically commoned with each other, the strain relief member being integrally formed with the leadframe.

7. The modular plug of claim 1, wherein the plug housing extends from a mating end to a cable end, the spring beam being configured to be deflected in a direction generally toward the mating end of the plug housing as the spring beam is engaged with the cable.

8. The modular plug of claim 1, wherein the plug is configured to mate with a modular jack along a connection axis, the plug housing extending from a mating end to a cable end, the spring beam being angled relative to the connection axis in a direction generally toward the mating end of the plug housing.

9. The modular plug of claim 1, wherein the plug housing and the plug contacts are shaped and positioned to define an RJ-45 modular plug mating interface.

10. A modular plug comprising:

a plug housing;

plug contacts held by the plug housing;

a strain relief member held by the plug housing, the strain relief member comprising a base and a spring beam cantilevered from the base, wherein the strain relief member is integrally formed with at least one of the plug contacts; and a stuffer cap pivotally coupled to the plug housing, the stuffer cap comprising a cable channel configured to receive a cable therein, the stuffer cap comprising an interior side that defines at least a portion of the cable channel, the stuffer cap being configured to press wires of the cable into electrical contact with the plug contacts when the stuffer cap is pivoted to a closed position, the stuffer cap comprising a slot that extends through the stuffer cap into the cable channel, the slot being configured to receive the spring beam of the strain relief member therein as the stuffer cap is pivoted to the closed position such that the spring beam pinches the cable between the interior wall of the stuffer cap and the spring beam.

11. The modular plug of claim 10, wherein the spring beam is configured to be deflected in a direction generally toward a base of the plug housing as the spring beam pinches the cable.

12. The modular plug of claim 10, wherein the spring beam is a first spring beam, the strain relief member further comprising a second spring beam cantilevered from the base of the strain relief member such that the first and second spring beams oppose each other.

13. The modular plug of claim 10, further comprising a leadframe that includes a group of the plug contacts that are electrically commoned with each other by a commoning pad, the strain relief member extending outward from the commoning pad.

14. The modular plug of claim 10, further comprising a leadframe that includes a group of the plug contacts that are electrically commoned with each other, the strain relief member being integrally formed with the leadframe.

15. The modular plug of claim 10, wherein the plug housing extends from a mating end to a cable end, the spring beam being configured to be deflected in a direction generally toward the mating end of the plug housing as the spring beam pinches the cable.

16. The modular plug of claim 10, wherein the plug is configured to mate with a modular jack along a connection axis, the plug housing extending from a mating end to a cable end, the spring beam being angled relative to the connection axis in a direction generally toward the mating end of the plug housing.

17. The modular plug of claim 10, wherein the plug housing and the plug contacts are shaped and positioned to define an RJ-45 modular plug mating interface.

18. A modular plug comprising:

a cable having an insulative cable jacket and an end;

a plug housing;

plug contacts held by the plug housing;

a stuffer cap coupled to the plug housing, the stuffer cap comprising a cable channel and an interior side that defines at least a portion of the cable channel, the end of the cable being received within the cable channel; and a strain relief member held by the plug housing, the strain relief member comprising a base and a spring beam cantilevered from the base, wherein the spring beam is engaged with the insulative jacket of the cable such that the cable is pinched between the interior side of the stuffer cap and the spring beam, wherein the strain relief member is integrally formed with at least one of the plug contacts.

19. The modular plug of claim 18, wherein the spring beam is a first spring beam, the strain relief member further comprising a second spring beam cantilevered from the base of the strain relief member such that the first and second spring beams oppose each other.

* * * * *